US005553371A

United States Patent [19]

Uchino et al.

[11] Patent Number: 5,553,371

[45] Date of Patent: Sep. 10, 1996

[54] METHOD OF MANUFACTURING FRICTION PLATES

[75] Inventors: Ryuichi Uchino, Kariya; Tadashi Higuchi, Aichi-ken; Takaaki Nakano, Kariya; Shigenobu Tara, Anjyo, all of Japan

[73] Assignee: Aisin Seiki Kabushiki Kaisha, Kariya, Japan

[21] Appl. No.: 449,072

[22] Filed: May 24, 1995

[30] Foreign Application Priority Data

May 25, 1994 [JP] Japan ..... 6-111401
Apr. 27, 1995 [JP] Japan ..... 7-103828

[51] Int. Cl.[6] ..... B21B 1/46

[52] U.S. Cl. ..... 29/527.2; 192/107 M; 419/8

[58] Field of Search ..... 192/107 M; 29/527.2; 419/8

[56] References Cited

U.S. PATENT DOCUMENTS

| | | | |
|---|---|---|---|
| 3,742,585 | 7/1973 | Wentzell | 29/527.2 X |
| 4,010,831 | 3/1977 | Reuter . | |
| 4,576,872 | 3/1986 | Ward | 419/8 X |
| 4,770,283 | 9/1988 | Pütz et al. . | |
| 5,230,138 | 7/1993 | Shiga et al. | 29/527.2 |
| 5,408,736 | 4/1995 | Ammer et al. | 29/527.2 |

FOREIGN PATENT DOCUMENTS

| | | | |
|---|---|---|---|
| 2596121 | 9/1987 | France . | |
| 2021635 | 11/1970 | Germany . | |
| 3025791 | 6/1981 | Germany . | |
| 63-123544 | 5/1988 | Japan . | |
| 257646 | 6/1970 | U.S.S.R. | 29/527.2 |
| 1406455 | 9/1975 | United Kingdom . | |
| 1460592 | 1/1977 | United Kingdom | 29/527.2 |

*Primary Examiner*—Carl J. Arbes
*Attorney, Agent, or Firm*—Oblon, Spivak, McClelland, Maier, & Neustadt, P.C.

[57] ABSTRACT

A friction plate in the shape of a disc is used in a clutch device to transfer a rotational torque from a driving member to a driven member and has frictional thin films on its side surface. These films are formed by spraying particulate materials on the side surfaces of the friction plate. According to the present invention the thin films are compressed by a compression roller arranged on the way of a path for feeding the metal strip having the thin film on its side surfaces.

2 Claims, 3 Drawing Sheets

METHOD OF MANUFACTURING FRICTION PLATES

BACKGROUND OF THE INVENTION

The present invention relates to a method of manufacturing friction plates for transmitting torque of a driving member to a driven member.

For example, an automatic transmission for use in vehicles employs a friction device such as a clutch device having a plurality of friction plates axially slidably supported on the driving member, and a plurality of friction plates axially slidably supported on the driven member. The frictional engagement of these friction plates which are sandwiched allows to transmit torque from the driven member to the driving member.

The frictional plate is normally formed in a disc-like shape and made of a metal material. An example of the friction plates is illustrated in FIG. 4 which has frictional side surfaces 30, 30 and free ends 30*a*, 30*a*, but welded after forming the usual shape of the disc. In order to increase a frictional efficiency of the friction plates, powdered or particulate frictional materials such as a metal or ceramic are coated on the frictional side surfaces 30, 30 of the friction plates with a bonding agent. The coating of the frictional materials on the frictional side surfaces of the friction plates is laborious and time-consuming task. As a result, a thermal flame spraying of frictional materials is employed to deposite them or the frictional side surfaces.

However, a conventional thermal flame spraying has a drawback that a part of the frictional materials as sprayed on the frictional side surfaces is often peeled off during operation of the friction device because of feebly deposited frictional materials on the frictional side surfaces of the friction plates.

SUMMARY OF THE INVENTION

Accordingly, an object of the present invention is to dissolve an afore-mentioned drawback by realizing a thermally sprayed film on a substrate which is excellent in resistance to abrasion and peeling.

Another object of the present invention is to provide a method of manufacturing friction plates having thermally sprayed and rolled thin films on its side surfaces.

According to the present invention, the foregoing object is attained by providing a method of manufacturing friction plates comprising spraying powdered or particulate frictional materials onto at least one side surface of a substrate to form a thin film thereonto, and compressing the thin film on the substrate.

In another aspect of the present invention, the foregoing object is attained by providing a method of manufacturing friction plates comprising spraying powdered or particulate frictional materials onto at least one side surface of a metal strip to form a thin frictional film thereonto, compressing the thin frictional film on the metal strip by means of a compression roller while pushing the metal strip by a feed roller, transforming the straight metal strip into a generally circular profile by means of a metal strip bending means, severing one point of the metal strip of the circular profile, and welding free ends of the disc profile to form a complete disc profile.

Preferably, the compression force to the thin frictional film ranges from 70 to 90 kg/cm$^2$ and is adjusted by a pressure control means.

The compression of the thin film on the substrate or metal strip is helpful in obtaining excellent adherence between the thin film and the substrate or metal strip to prevent peeling of the frictional materials.

For compression of the thin film the compression roller is utilized so that complex procedure or expensive equipment is unnecessary. The use of the pressure control means assists the thin film to tightly adhere to the abstrate or metal strip.

The invention will be better understood and the other objects and advantages thereof will be more apparent from the following detailed description of preferred embodiment with reference to the accompanying drawings.

DESCRIPTION OF THE PREFERRED EMBODIMENT

Figure 1:
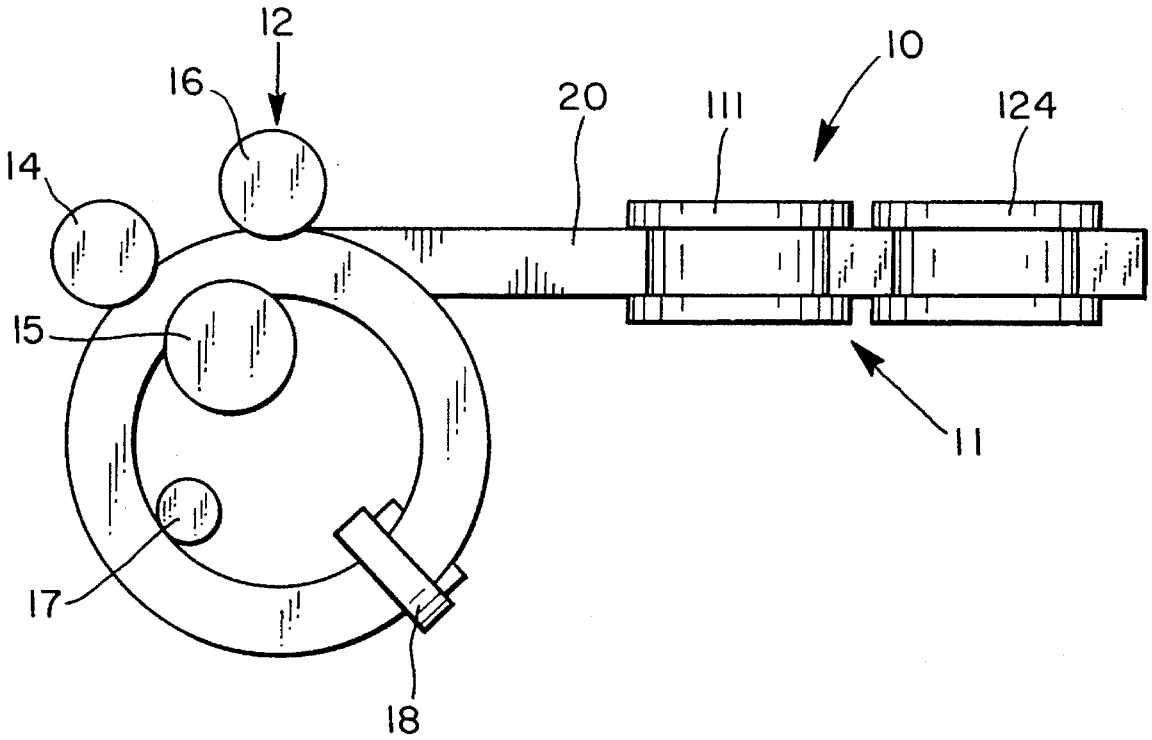
FIG. 1 is a diagram showing part of apparatus for the bending of metal strip into a disc profile.
Figure 2:
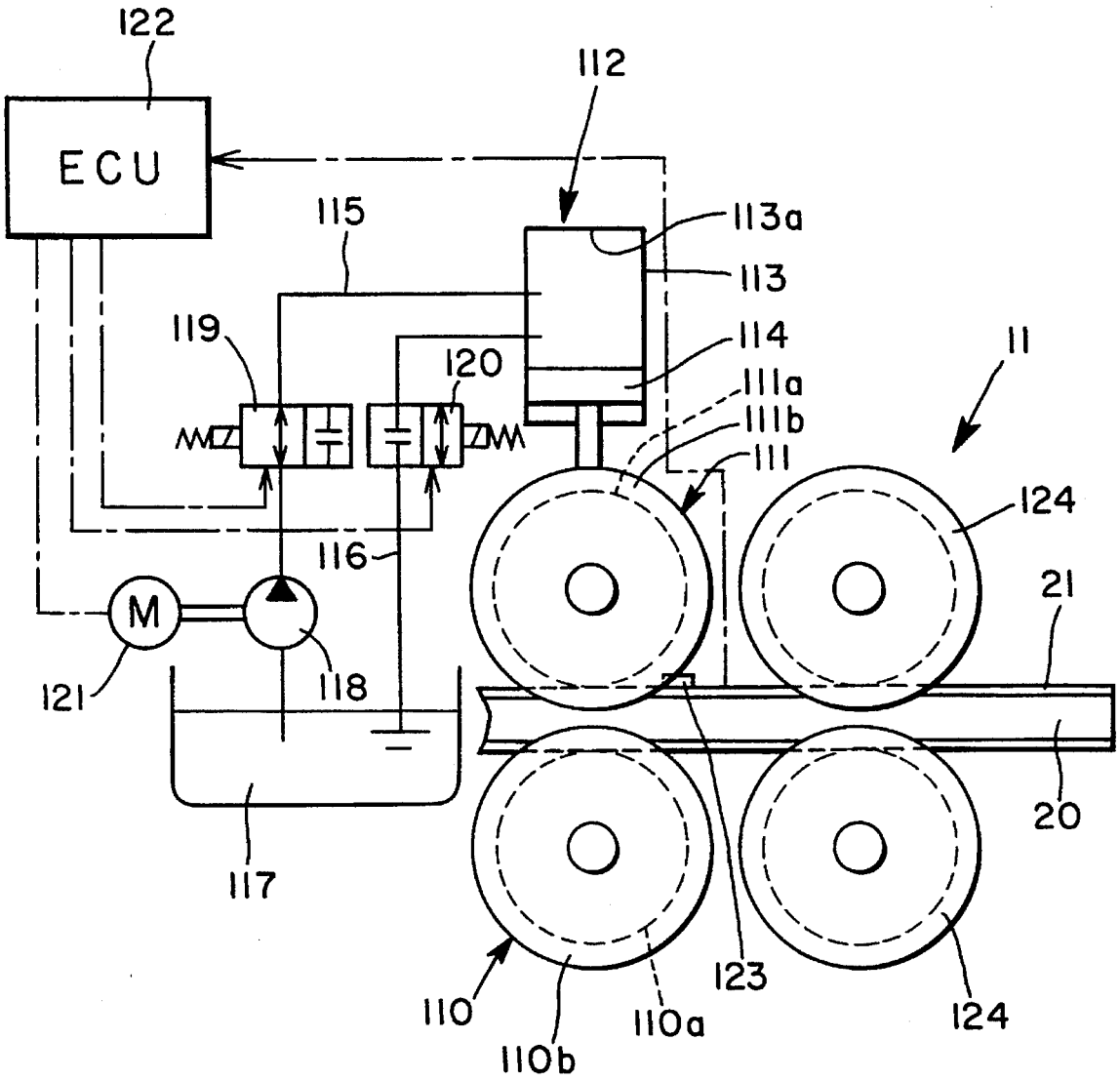
FIG. 2 is a diagram showing a relation of a pressure control means and feed roller.

Refer to FIG. 1 an apparatus 10 for transforming a straight metal strip 20 having thin frictional films 21, 21 on its side surfaces into disc shape friction plates comprises a metal strip feed means 11 and a metal strip bending means 12. The feed means 11 includes feed roller 110 for pushing the straight metal strip in one direction and compression roller 111 for compressing thin frictional film on the metal strip on the way of the feed passage of the metal strip, which usually co-operate with the feed roller 110 as shown in FIG. 2. 124 denotes a pair of guide rollers. The bending means 12 includes a guide roller 16 for maintaining the metal strip 20 aligned in a straight path, a core roller 15 alongside which the metal strip passes, a movable bending roller 14 for exerting a bending force on the metal strip 20 to bend it about the core roller 15, a pull-back roller 17 for stabilizing radius of curvature needed in the disc profile of the friction plate, and a cropper 18 for separating the disc shaped strip from the oncoming metal strip. The free ends of the friction plate are welded in a conventional manner.

Refer to FIG. 2 wherein the feed means 11 which is effective in performing a method of the present invention is illustrated. To control the compression force which is exerted through the compression roller 111 on the thin frictional films 21, 21 sprayed onto the metal strip 20 and drive the feed roller 110, the apparatus 10 is equipped with a compression roller driving means 112. The feed roller 110 has a cylindrical portion 110*a* in contact with the metal strip 20 and flange portions 110*b* for arranging the metal strip aligned in a straight path. The compression roller 111 has a cylindrical portion 111*a* to apply a compression force onto the metal strip 20 by co-operating with the feed roller 110 and flange portions 111*b* for arranging the metal strip aligned in a straight path.

The compression roller driving means 112 includes a hydraulic cylinder 113, a piston 114 connected with the compression roller 111 and defining a pressure chamber 113*a* in a bore of the hydraulic cylinder 113, an oil supply passage 115 arranged between an oil pan 117 and the pressure chamber 113*a*, an oil pump 118 for drawing the oil up out of the oil pan 117, an oil return passage 116 for returning the oil in the pressure chamber 113*a* into the oil pan 117, a first solenoid valve 119 for cut-off of a flow of the oil from the oil pan 117 toward the pressure chamber 113*a*, a second solenoid valve 120 for cutting off a flow of the oil from the preesure chamber 113*a* to the oil pan 117, a hydraulic motor 121 for driving the oil pump 118, a pressure sensor 123 for detecting the magnitude of compression force exerted on the metal strip 20 through the thin frictional films 21, and an electronic control unit (ECU) 122 for regulating the speed of the motor 121 and on-off states of the solenoid valves 119, 120 in response to the detecting signals of the sensor 123.

The compression force by the compression roller 111 is controlled by ECU 122 to the extent that the metal strip is not plastically deformed. In view of the plactic deformation of the metal strip 20, such as a stainless steel, the compression force is from about 70 kg/cm$^2$ to 90 kg/cm$^2$, preferably 80 kg/cm$^2$. The illustrated embodiment uses one compression roller 111 and one compression roller driving means 112. However, a plurality of compression rollers and a plurality of compression roller driving means can be used.

Figure 3:
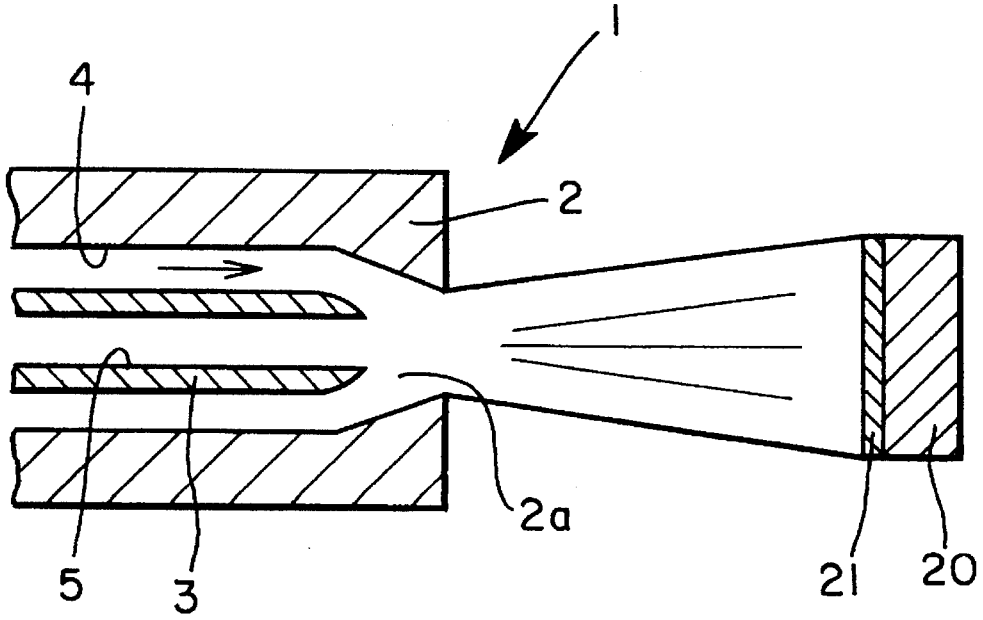
FIG. 3 is a sectional view showing a combustion gas flame spraying menas.
Figure 4:
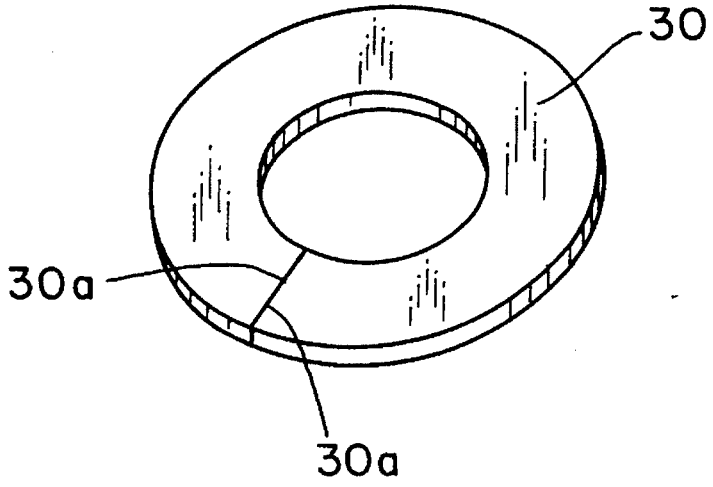
FIG. 4 (PRIOR ART)
FIG. 4 is a perspective view showing a friction plate of a disc profile.

FIG. 3 shows an example of a spray means 1 to form the thin frictional films 21, 21 on side surfaces of the metal strip 20. The spray means 1 has a hollow nozzle 2 having a converging throat 2*a*, and a tube axially aligned with the hollow nozzle 2 to define a high pressure gas supply annular passage 4. The tube 3 has a central passage 5 for allowing unconstricted flow of particulate frictional materials such as metals, metal alloys metal oxides, and the like and combinations threrof. A mixture of an oxigen containing gas and a fuel gas such as propane gas which is at a high pressure is ignited at the converging throat 2*a*. The expanding, high temperature combustion gases are forced outwardly through the converging throat 2*a* where the gases achieve supersonic velocities and then the particulate frictional materials are fed from the central passage 5 into the gas stream at the supersonic velocities to produce a high temperature, high velocity particle stream. This stream is sprayed on the metal strip 20 to form the thin frictional film 21 by the deposition of the frictional materials. To form the thin frictional film 21, a thermal flame spraying, a plasma spraying, or an electric arc spraying may be employed.

As many apparently widely different embodiments of the present invention can be made without departing from the spirit and scope thereof, it is to be understood that the invention is not limited to the specific embodiments thereof except as defined in the appended claims.

What is claimed is:

1. A method of manufacturing friction plates comprising the steps of:

spraying powdered or particulate frictional materials onto at least one side surface of a metal strip to form a thin frictional film thereonto;

feeding and compressing the metal strip having the thin frictional film between a compression roller and a feed roller by moving the compression roller in the direction of the feed roller to compress the thin frictional film;

transforming the straight metal strip into a generally circular profile by means of a metal strip bending means;

severing one point of the metal strip of the circular profile; and welding free ends of the circular profile to form a disc profile friction plate.

2. A method of manufacturing friction plates according to claim 1, wherein the compression force to the thin frictional film ranges from 70 to 90 kg/cm$^2$ and is adjusted by a pressure control means.

* * * * *